US010010159B1

(12) United States Patent
Gonzales

(10) Patent No.: US 10,010,159 B1
(45) Date of Patent: Jul. 3, 2018

(54) BACKPACK FOR CARRYING COLLAPSIBLE CHAIRS

(71) Applicant: Badger Gear, LLC, Cedar Park, TX (US)

(72) Inventor: Jeff Gonzales, Cedar Park, TX (US)

( * ) Notice: Subject to any disclaimer, the term of this patent is extended or adjusted under 35 U.S.C. 154(b) by 0 days.

(21) Appl. No.: 15/586,436

(22) Filed: May 4, 2017

Related U.S. Application Data

(63) Continuation of application No. 29/594,118, filed on Feb. 15, 2017.

(51) Int. Cl.

| | |
|---|---|
| ***A45F 3/12*** | (2006.01) |
| ***A45F 3/04*** | (2006.01) |
| ***A44B 11/00*** | (2006.01) |
| ***A47C 4/00*** | (2006.01) |
| *A45F 3/00* | (2006.01) |

(52) U.S. Cl.
CPC ..... *A45F 3/047* (2013.01); *A44B 11/00* (2013.01); *A45F 3/12* (2013.01); *A47C 4/00* (2013.01); *A45F 2003/003* (2013.01); *A45F 2003/122* (2013.01)

(58) Field of Classification Search
CPC ..... A45F 3/12; A45F 3/047; A45F 2003/122
USPC ..... 224/629, 636
See application file for complete search history.

(56) References Cited

U.S. PATENT DOCUMENTS

| | | | | | |
|---|---|---|---|---|---|
| 4,609,084 | A * | 9/1986 | Thomas | A45C 9/00 | 190/110 |
| 5,002,401 | A * | 3/1991 | Blackman | A45C 7/0095 | 150/112 |
| 5,012,964 | A * | 5/1991 | Falletta | A45F 3/04 | 224/153 |
| 5,411,192 | A * | 5/1995 | Xiao | A45F 4/02 | 108/42 |
| 5,544,792 | A * | 8/1996 | Arnwine | A45C 7/0086 | 224/153 |
| 5,628,443 | A * | 5/1997 | Deutsch | A45C 7/0086 | 150/113 |
| 5,676,293 | A * | 10/1997 | Farris | A45F 3/04 | 2/175.7 |
| 5,704,529 | A * | 1/1998 | Santoro | A45F 3/04 | 224/242 |
| 6,024,265 | A * | 2/2000 | Clements | A45F 3/04 | 224/259 |
| 6,112,959 | A * | 9/2000 | Townsend | A45C 11/22 | 224/153 |
| 6,164,509 | A * | 12/2000 | Gausling | A45F 3/04 | 224/153 |
| 8,079,503 | B1 * | 12/2011 | Yeates | A45C 7/0086 | 224/268 |
| 8,397,965 | B2 * | 3/2013 | Eberle | A45F 3/04 | 224/637 |
| 9,205,782 | B2 * | 12/2015 | Byham | B60R 7/043 | |
| 2011/0186611 | A1 * | 8/2011 | Eberle | A45F 4/00 | 224/583 |
| 2011/0204114 | A1 * | 8/2011 | Miller | A45F 3/04 | 224/582 |

(Continued)

*Primary Examiner* — Brian D Nash
(74) *Attorney, Agent, or Firm* — Hulsey P.C.

(57) ABSTRACT

A portable backpack for the storage and transport of a collapsible quad chair, in which the insertion or removal of the collapsible quad chair is enabled by maintaining the shape of the opening through placement of the flap away from the opening to prevent deformation of the opening.

17 Claims, 5 Drawing Sheets

(56) References Cited

U.S. PATENT DOCUMENTS

2016/0015155 A1* 1/2016 Patel ..... A44B 19/382
224/581

* cited by examiner

BACKPACK FOR CARRYING COLLAPSIBLE CHAIRS

FIELD OF THE INVENTION

The present disclosure relates to backpacks. More specifically, the disclosure relates to a backpack for carrying collapsible chairs.

BACKGROUND OF THE INVENTION

Quad chairs, which are collapsible, are popular with consumers because they can be readily folded and stored. Such features enable quad chairs to be transported and used during recreational activities, such as during camping. Known collapsible quad chairs include a frame that is selectively moveable between a collapsed or folded configuration when the chair is not in use and a non-folded configuration during use. When in a collapsed configuration, the feet of the quad chair form a smaller square or rectangular shape than when in the non-collapsed configuration. A fabric frame cover is coupled to the frame to define a back portion and a seat portion of the quad chair such that a user may sit on the seat portion and have his or her back positioned against the back portion.

Overall, when in the collapsed configuration, the quad chair forms a rectangular prism. While more convenient for storage and carrying, the multiple feet of the chair can make it challenging to place into most carrying cases. The feet and crumpled up fabric of the quad chair will catch onto edges of any bag or carrying case.

Known quad chairs are not as light as they might look. The advantage of quad chairs is that they are easy to collapse into a small configuration or expand into a durable and stable seat. This functionality requires multiple heavy components for the joints and frame. The added complexity of the design makes the quad chairs heavy and difficult to carry multiple quad chairs at the same time.

A problem associated with current means for carrying quad chairs is that they only contain one chair and one strap. One strap prevents a user from positioning the chair in a more controllable fashion that would allow for better weight distribution.

Additionally, the collapsible nature of quad chairs ads a level of danger to carrying a quad chair. A person carrying a quad chair that is not enclosed in a bag must be very careful when holding a collapsed quad chair, otherwise their fingers may get crushed when the quad chair expands or collapsed due to a change in force on the chair.

Ultimately, the benefits of quad chairs make them heavy and hazardous to carry. There exists a need for a carrying apparatus that allows for easy loading of quad chairs, better distribution of the weight, and protection of the user's appendages.

BRIEF SUMMARY OF THE INVENTION

According to the present disclosure, embodiments address limitations of current means for carrying multiple collapsible chairs. The present disclosure provides in embodiments a semi-rigid backpack for carrying collapsible chairs, hereafter backpack, which may be easily transported, may provide for easy loading of a collapsible chair, better weight distribution, and additionally, may prevent injuries that may occur while carrying collapsible chairs that are not completely enclosed.

BRIEF DESCRIPTION OF THE DRAWINGS

The novel features believed characteristic of the disclosed subject matter will be set forth in any claims that are filed later. The disclosed subject matter itself, however, as well as a preferred mode of use, further objectives, and advantages thereof, will best be understood by reference to the following detailed description of an illustrative embodiment when read in conjunction with the accompanying drawings, wherein:

DETAILED DESCRIPTION OF ILLUSTRATIVE EMBODIMENTS

Reference now should be made to the drawings, in which the same reference numbers are used throughout the different FIGUREs to designate the same components.

It will be understood that, although the terms first, second, third, etc. may be used herein to describe various elements, these elements should not be limited by these terms. These terms are only used to distinguish one element from another element. Thus, a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. Embodiments of the present disclosure may vary in size and configuration.

The embodiment is preferably made up of heavy fabric or nylon. Alternatively, embodiments may be comprised of any flexible and durable material. Optionally, the material may be waterproof, stain resistant, wear resistant, or flame resistant.

Figure 1:
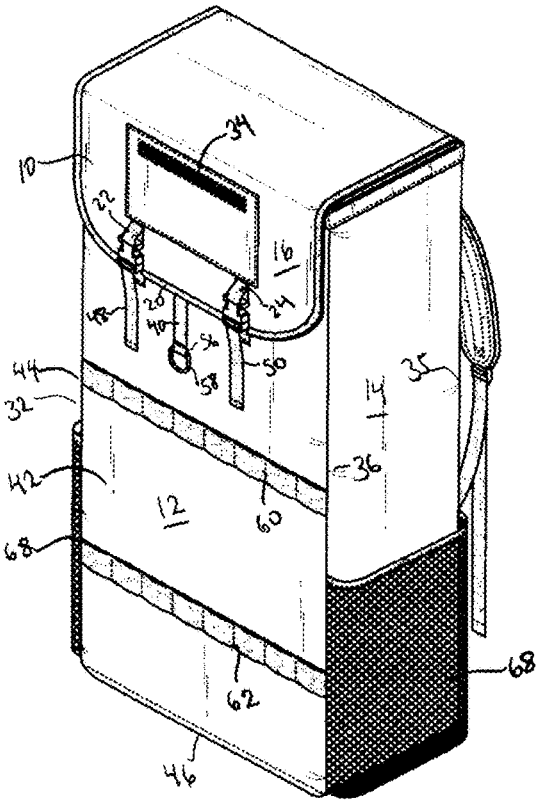
FIG. 1 illustrates a top front perspective view of an embodiment of the inventive subject matter in use configuration.

FIG. 1 generally depicts a top front perspective of an embodiment, having a flap 10, a front panel 12, and a second side panel 14. The top front perspective helps illustrate how the backpack contains the quad chairs inside of the backpack with a flap 10 that can be easily opened and closed.

The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 39 of the front panel 12, the top end 28 of the back panel 26, the first side panel 32, and the second side panel 14. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

The second side panel 14, connected to the second side end 36 of the front panel 12, the second side end 35 of the back panel 26, and the reinforced bottom 38, for the purpose of creating an enclosure for the backpack and providing support to create the rectangular opening to insert the quad chair. However, other alternatives are contemplated. For example, second side panel 14 may comprised an open side pocket 68 for holding items.

The front panel 12, comprises an exterior surface 42, first side end 44, a second side end 36, a bottom end 46, and a top end 78. The first side end 44 is connected to the first side panel 32 using stitching or adhesive. The second side end 36 is connected to the second side panel 14 using stitching or adhesive. The bottom end 46 is connected to the reinforced bottom 38 using stitching or adhesive. The exterior surface 42 of the front panel 12 comprises a first lower buckle strap 48 attached with stitching or adhesive to the third of the back panel 26. The buckles and buckle straps are to connect with the buckle straps of the flap 10, to allow for detachably closing the flap 10. A D-ring strap 40 is attached to the front panel 12 with stitching or adhesive. The D-ring strap 40 comprises a looped end 56 enabling a D-ring 58 to be connected.

Additionally, a upper molle strap 60 and a lower molle strap 62 are attached to the front panel 12 with stitching or adhesive. The lower molle strap 62 is attached towards the bottom end 46 of the front panel 12. The upper molle strap 60 is attached to the front panel 12 between the d-ring strap 40 and the lower molle strap 62. The molle straps enable string, rope, or other tying means to be looped through the molle straps and retain an item on the backpack.

Figure 2:
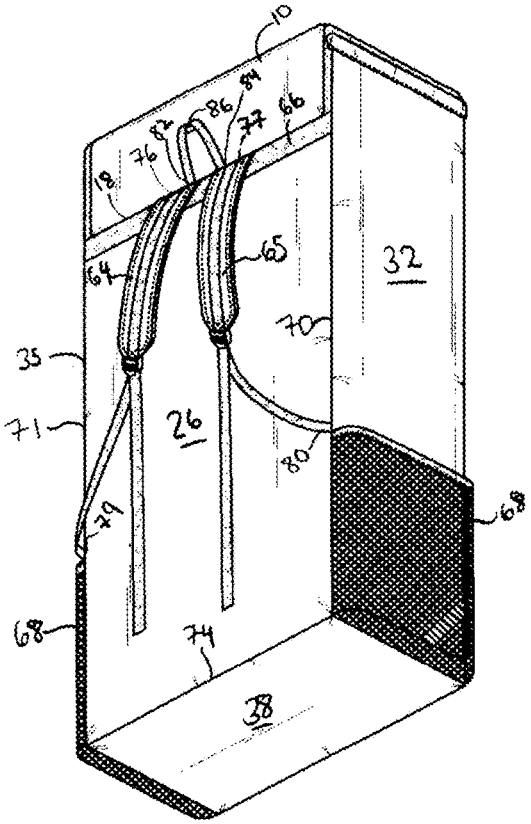
FIG. 2 illustrates a bottom back perspective view of an embodiment of the inventive subject matter in storage configuration encased in a carrying case.

FIG. 2 generally depicts a bottom back perspective view of an embodiment, having a back panel 26, a flap 10, a first side panel 32, a first strap 64 and a second strap 65, a loop 86, a reinforcement strap 66, an open side pocket 68, and a reinforced bottom 38. The illustrated embodiment and positioning of the elements enables the embodiment to be carried on the back of a user.

The back panel 26, comprises a first side end 70, a second side end 71, a bottom end 74, and a top end 28. The back panel 26 is preferably heavy fabric or nylon. Alternatively, embodiments of back panel 26 may be comprised of any flexible and durable material. Optionally, the material may be waterproof, stain resistant, wear resistant, or flame resistant.

The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 78 of the front panel 12, the top end 28 of the back panel 26, the first side panel 32, and the second side panel 14. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

The first side panel 32, connected to first side end 44 of the front panel 12, the first side end 70 of the back panel 26, and the reinforced bottom 38, for the purpose of creating an enclosure for the backpack and providing support to create the rectangular opening to insert the quad chair. However, other alternatives are contemplated. For example, first side panel 32 may comprised an open side pocket 68 for holding items.

The first strap 64 comprises a first end 76 and a second end 79. The first end 76 of the first strap 64 is connected by stitching or adhesive to the back panel 26 near the point of attachment for the flap 10 on the back panel 26. The second end 79 of the first strap 64 is connected by stitching or adhesive to the back panel 26 in a position closer to the bottom end of the back panel 26. The two points of connection create a loop, enabling a user to place their arm through the first strap 64 so the backpack may rest on the shoulder of the user. However, other alternatives are contemplated. For example, the first strap 64 may have padded surfaces or pockets attached.

The second strap 65 comprises a first end 77 and a second end 80. The first end 77 of the second strap 65 is connected by stitching or adhesive to the back panel 26 near the point of attachment for the flap 10 on the back panel 26. The second end 80 of the second strap 65 is connected by stitching or adhesive to the back panel 26 in a position closer to the bottom end of the back panel 26. The two points of connection create a loop, enabling a user to place their arm through the second strap 65 so the backpack may rest on the shoulder of the user. However, other alternatives are contemplated. For example, the second strap 65 may have padded surfaces or pockets attached.

The loop 86, comprises a first end 82 and a second end 84 connected to the back panel 26 between the connection point of the first strap 64 and the second strap 65, and the flap 10. The loop 86 is connected by stitching or adhesive. The loop 86 serves to provide a location to place the backpack on a hook or for a user to easily grab and control the backpack.

The reinforcement strap 66, is connected by stitching or adhesive to the back panel 26, the flap 10, the first strap 64, the second strap 65, and the loop 86. The reinforcement strap 66 connects to the back panel 26 in a manner so that the flap 10, the first strap 64, the second strap 65, and the loop 86 are positioned between the reinforcement strap 66 and the back panel 26. The reinforcement strap 66 serves to distribute force placed on the first strap 64, the second strap 65, the flap 10, and the loop 86. By distributing the force, the connection points for the first strap 64, the second strap 65, the flap 10, and the loop 86 will experience less wear and are less likely to fail or tear off of the back panel 26.

The reinforced bottom 38, is attached to the bottom end 46 of the front panel 12, the bottom end 74 of the back panel 26, the first side panel 32, and the second side panel 14. The reinforced bottom 38 prevents items inside the backpack enclosure from falling out. In some embodiments the reinforced bottom 38 may be made of more layers, thicker material, or have added stitching to enable a stronger and more durable area of the embodiment because it will receive the bulk of the force from any items contained within the backpack.

Figure 3:
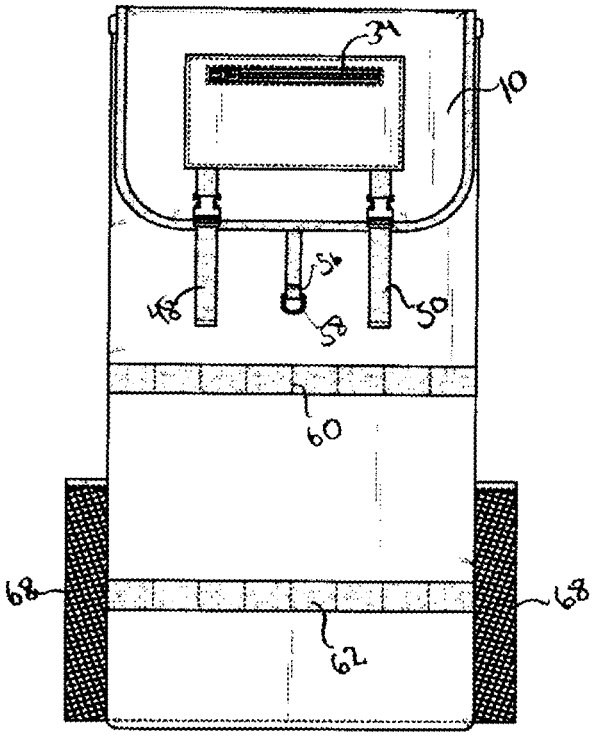
FIG. 3 illustrates front view of an embodiment of the inventive subject matter in a use configuration.

FIG. 3 generally depicts a front view of an embodiment, having a flap 10, and a front panel 12. The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 78 of the front panel 12, the top end 28 of the back panel 26, the first side panel 32, and the second side panel 14. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

The front panel 12, comprises an exterior surface 42, a first side end 44, a second side end 36, a bottom end 46, and a top end 78. First side end 44 is connected to the first side panel 32 using stitching or adhesive. The second side end 36 is connected to the second side panel 14 using stitching or adhesive. The bottom end 46 is connected to the reinforced bottom 38 using stitching or adhesive. The exterior surface 42 of the front panel 12 comprises a first lower buckle strap 48 attached with stitching or adhesive to the third of the back panel 26 closest to the first side end 44. The first lower buckle strap 48 comprises a first buckle 33 attached to one end of the first lower buckle strap 48. The second lower buckle strap 50 comprises a second buckle 52 attached to one end of the second lower buckle strap 50. The buckles and buckle straps are to connect with the buckle straps of the flap 10, to allow for detachably closing the flap 10. A d-ring strap 40 is attached to the front panel 12 with stitching or adhesive between the first lower buckle strap 48 and the second lower buckle strap 50. The d-ring strap 40 comprises a looped end 56 enabling a D-ring 58 to be connected. Additionally, a upper molle strap 60 and a lower molle strap 62 are attached to the front panel 12 with stitching or adhesive. The lower molle strap 62 is attached towards the bottom end 46 of the front panel 12. The upper molle strap 60 is attached to the front panel 12 between the d-ring strap 40 and the lower molle strap 62. The molle straps enable string, rope, or other tying means to be looped through the molle straps and retain an item on the backpack.

Figure 4:
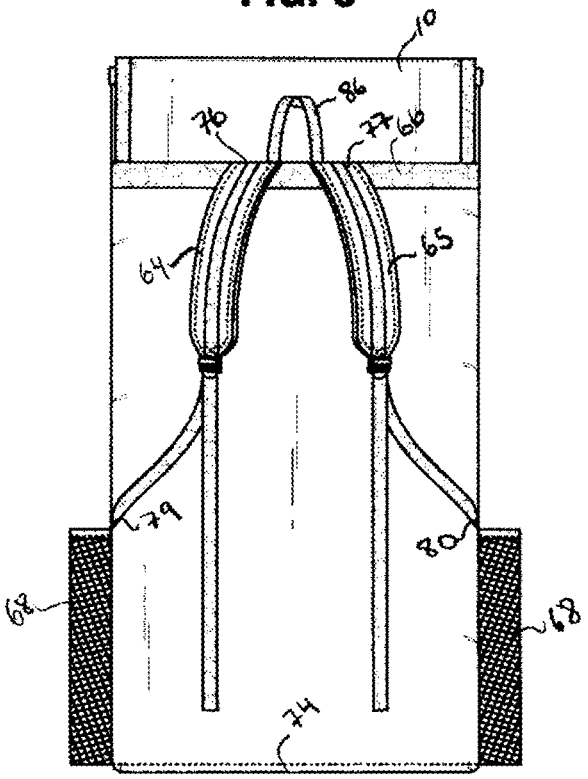
FIG. 4 illustrates a back view of an embodiment of the inventive subject matter in a storage configuration.

FIG. 4 generally depicts a back view of an embodiment, having a back panel 26, a flap 10, a first side panel 32, a first strap 64 and a second strap 65, a loop 86, and a reinforcement strap 66. The illustrated embodiment and positioning of the elements enables the embodiment to be carried on the back of a user. The back panel 26, comprises a first side end 70, a second side end 35, a bottom end 74, and a top end 28. The back panel 26 is preferably heavy fabric or nylon. Alternatively, embodiments of back panel 26 may be comprised of any flexible and durable material. Optionally, the material may be waterproof, stain resistant, wear resistant, or flame resistant.

The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 78 of the front panel 12, the top end 28 of the back panel 26, the first side panel 32, and the second side panel 14. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

The first strap 64, comprises a first end 76 and a second end 79. The first end 76 of the first strap 64 is connected by stitching or adhesive to the back panel 26 near the point of attachment for the flap 10 on the back panel 26. The second end 79 of the first strap 64 is connected by stitching or adhesive to the back panel 26 in a position closer to the bottom end of the back panel 26. The two points of connection create a loop, enabling a user to place their arm through the first strap 64 so the backpack may rest on the shoulder of the user. However, other alternatives are contemplated. For example, the first strap 64 may have padded surfaces or pockets attached.

The second strap 65, comprises a first end 77 and a second end 80. The first end 77 of the second strap 65 is connected by stitching or adhesive to the back panel 26 near the point of attachment for the flap 10 on the back panel 26. The second end 80 of the second strap 65 is connected by stitching or adhesive to the back panel 26 in a position closer to the bottom end of the back panel 26. The two points of connection create a loop, enabling a user to place their arm through the second strap 65 so the backpack may rest on the shoulder of the user. However, other alternatives are contemplated. For example, the second strap 65 may have padded surfaces or pockets attached.

The loop 86, comprises a first end 82 and a second end 84 connected to the back panel 26 between the connection point of the first strap 64 and the second strap 65, and the flap 10. The loop 86 is connected by stitching or adhesive. The loop 86 serves to provide a location to place the backpack on a hook or for a user to easily grab and control the backpack.

The reinforcement strap 66, is connected by stitching or adhesive to the back panel 26, the flap 10, the first strap 64, the second strap 65, and the loop 86. The reinforcement strap 66 connects to the back panel 26 in a manner so that the flap 10, the first strap 64, the second strap 65, and the loop 86 are positioned between the reinforcement strap 66 and the back panel 26. The reinforcement strap 66 serves to distribute force placed on the first strap 64, the second strap 65, the flap 10, and the loop 86. By distributing the force, the connection points for the first strap 64, the second strap 65, the flap 10, and the loop 86 will experience less wear and are less likely to fail or tear off of the back panel 26.

Figure 5:
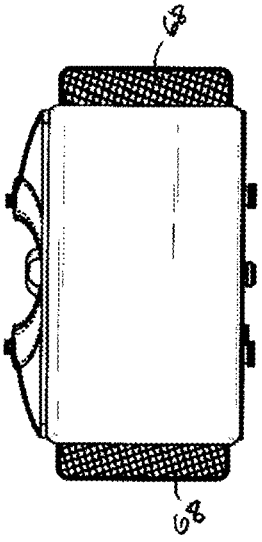
FIG. 5 illustrates a bottom view of an embodiment of the inventive subject matter having a counterweight with suction cups.

FIG. 5 generally depicts a bottom view of an embodiment, showing a reinforced bottom 38. The reinforced bottom 38 prevents items inside the backpack enclosure from falling out. In some embodiments the reinforced bottom 38 may be made of more layers, thicker material, or have added stitching to enable a stronger and more durable area of the embodiment because it will receive the bulk of the force from any items contained within the backpack.

Figure 6:
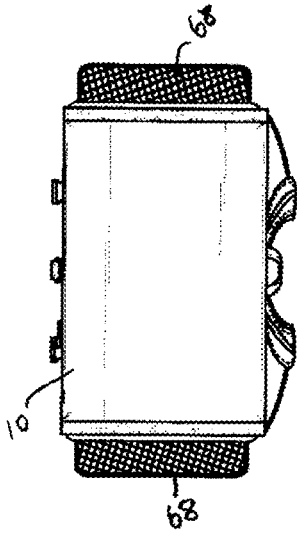
FIG. 6 illustrates a top view of an embodiment of the counterweight having suction cups.

FIG. 6 generally depicts a top view of an embodiment, showing a flap 10. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

Figure 7:
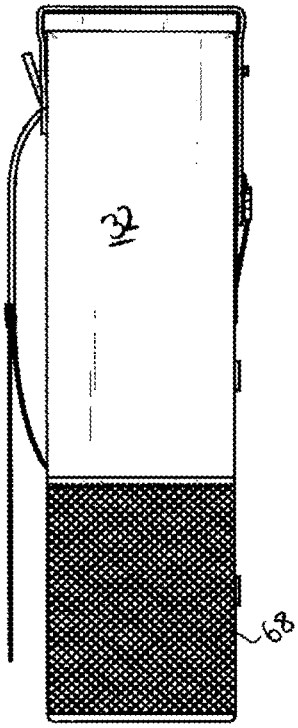
FIG. 7 illustrates a side view of an embodiment of the counterweight having suction cups.

FIG. 7 generally depicts a side view of an embodiment having a second side panel 14 and an open side pocket 68. The second side panel 14 may include an open side pocket 68 that may be used for holding items such as liquid containers or other personal items. In some embodiments, the open side pocket 68 may include a cover to keep items from falling out.

Figure 8:
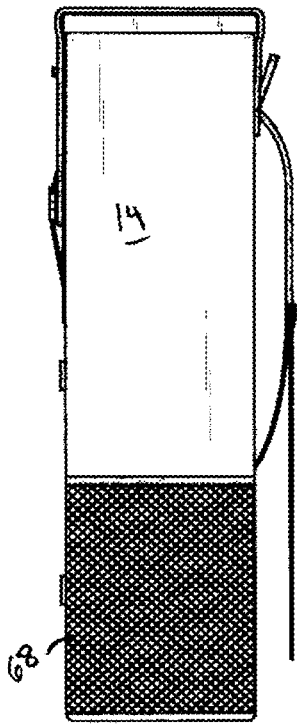
FIG. 8 illustrates a side view of an embodiment of the inventive subject matter in a storage configuration.

FIG. 8 generally depicts a side view of an embodiment having a first side panel 32, connected to the first side end of the front panel 12, the first side end of the back panel 26, and the reinforced bottom, for the purpose of creating an enclosure for the backpack and providing support to create the rectangular opening to insert the quad chair. However, other alternatives are contemplated. For example, first side panel 32 may comprised an open side pocket 68 for holding items.

Figure 9:
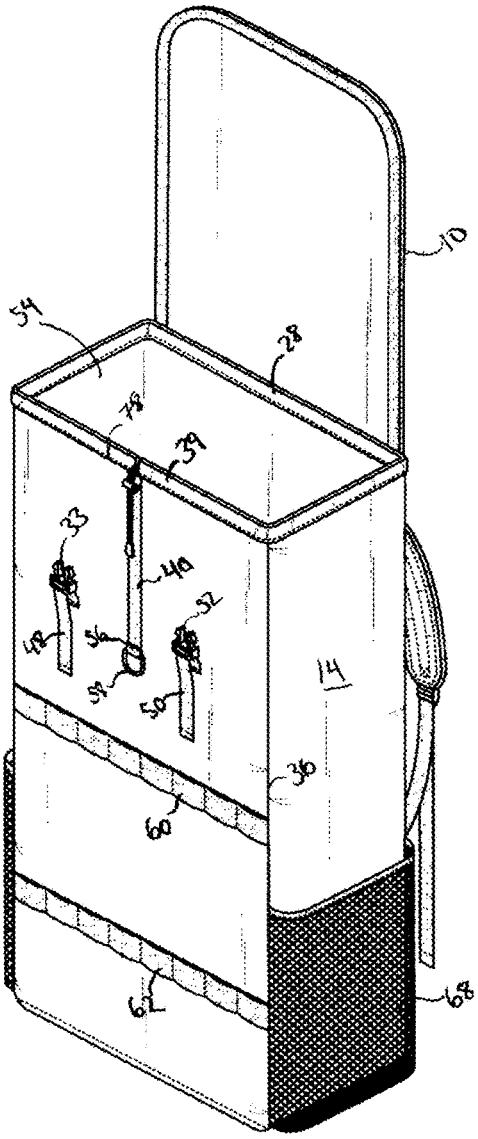
FIG. 9 illustrates a top front perspective view with an open flap.

FIG. 9 generally depicts a top front perspective of an embodiment, having a flap 10, a front panel 12, and a second side panel 14. The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 78 of the front panel 12, the top end 28 of the back panel 26, the first side panel 32, and the second side panel 14.

The second side panel 14, connected to the second side end 36 of the front panel 12, the second side end 35 of the back panel 26, and the reinforced bottom 38, for the purpose of creating an enclosure for the backpack and providing support to create the rectangular opening to insert the quad chair. However, other alternatives are contemplated. For example, second side panel 14 may comprised an open side pocket 68 for holding items.

Figure 10:
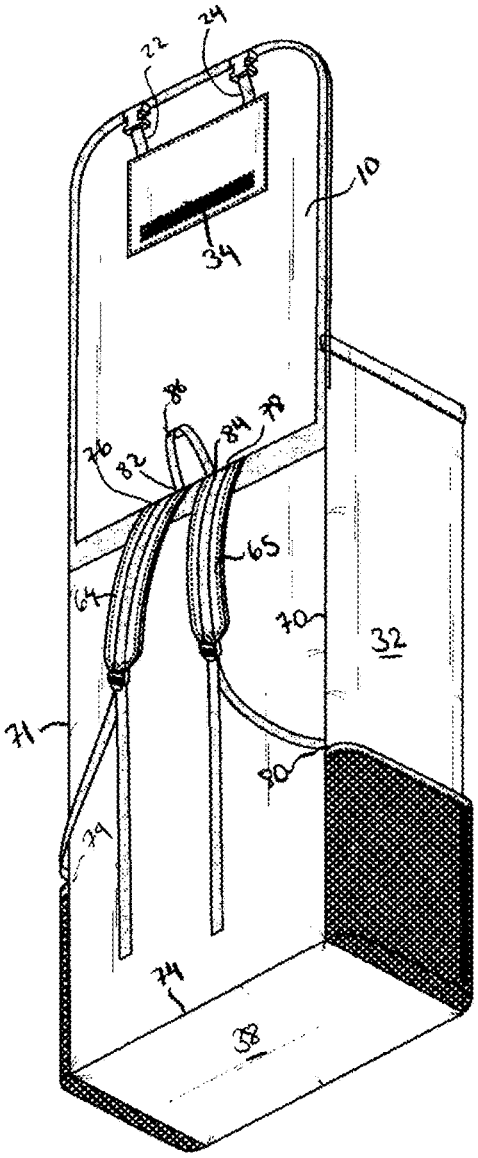
FIG. 10 illustrates a bottom back perspective view with an open flap.

FIG. 10 generally depicts a bottom back perspective view of an embodiment with an open flap 10, having a back panel 26, a flap 10, a first side panel 32, a first strap 64 and a second strap 65, a loop 86, a reinforcement strap 66, an open side pocket 68, and a reinforced bottom 38. The illustrated embodiment and positioning of the elements enables the embodiment to be carried on the back of a user.

The back panel 26, comprises a first side end 70, a second side end 35, a bottom end 74, and a top end 28. The back panel 26 is preferably heavy fabric or nylon. Alternatively, embodiments of back panel 26 may be comprised of any flexible and durable material. Optionally, the material may be waterproof, stain resistant, wear resistant, or flame resistant.

The flap 10, may comprises an exterior surface 16, a connection end 18, a buckle end 20, a first upper buckle strap 22, and a second upper buckle strap 24. The connection end 18 of the flap 10 is connected to the back panel 26 at least 6 inches away from the top end 28 of the back panel 26 to enclose the items contained in the backpack and to prevent the deformation of the rectangular opening created by the top end 78 of the front panel 12, the top end 28 of the back panel 26, the first side panel 32, and the second side panel 14. Preventing the deformation of the rectangular or square shape enables quad chairs to more easily be inserted into the backpack. If the opening of the backpack was easily deformed, the edges of the opening would easily catch on the legs or other components of the quad chair. By placing the flap 10 further away from the opening, the weight of the flap 10 is distributed among the back panel 26 and not focused on the top end 28 of the back panel 26 creating the opening. The flap 10 comprises a first upper buckle strap 22 and a second upper buckle strap 24 attached by stitching or adhesive to the buckle end of the flap 10. The buckle straps allow the flap 10 to be detachably connected to another part of the backpack to ensure the flap 10 stays closed. However, other alternatives are contemplated. For example, flap 10 can have a zippered pocket 34 on the exterior surface of the flap 10 for quick access to small items.

The first strap 64, comprises a first end 76 and a second end 79. The first end 76 of the first strap 64 is connected by stitching or adhesive to the back panel 26 near the point of attachment for the flap 10 on the back panel 26. The second end 79 of the first strap 64 is connected by stitching or adhesive to the back panel 26 in a position closer to the bottom end of the back panel 26. The two points of connection create a loop, enabling a user to place their arm through the first strap 64 so the backpack may rest on the shoulder of the user. However, other alternatives are contemplated. For example, the first strap 64 may have padded surfaces or pockets attached.

The second strap 65, comprises a first end 77 and a second end 80. The first end 77 of the second strap 65 is connected by stitching or adhesive to the back panel 26 near the point of attachment for the flap 10 on the back panel 26. The second end 80 of the second strap 65 is connected by stitching or adhesive to the back panel 26 in a position closer to the bottom end of the back panel 26. The two points of connection create a loop, enabling a user to place their arm through the second strap 65 so the backpack may rest on the shoulder of the user. However, other alternatives are contemplated. For example, the second strap 65 may have padded surfaces or pockets attached.

The reinforcement strap 66, is connected by stitching or adhesive to the back panel 26, the flap 10, the first strap 64, the second strap 65, and the loop 86. The reinforcement strap 66 connects to the back panel 26 in a manner so that the flap 10, the first strap 64, the second strap 65, and the loop 86 are positioned between the reinforcement strap 66 and the back panel 26. The reinforcement strap 66 serves to distribute force placed on the first strap 64, the second strap 65, the flap 10, and the loop 86. By distributing the force, the connection points for the first strap 64, the second strap 65, the flap 10, and the loop 86 will experience less wear and are less likely to fail or tear off of the back panel 26.

The reinforced bottom 38, is attached to the bottom end 46 of the front panel 12, the bottom end 74 of the back panel 26, the first side panel 32, and the second side panel 14. The reinforced bottom 38 prevents items inside the backpack enclosure from falling out. In some embodiments the reinforced bottom 38 may be made of more layers, thicker material, or have added stitching to enable a stronger and more durable area of the embodiment because it will receive the bulk of the force from any items contained within the backpack.

Figure 11:
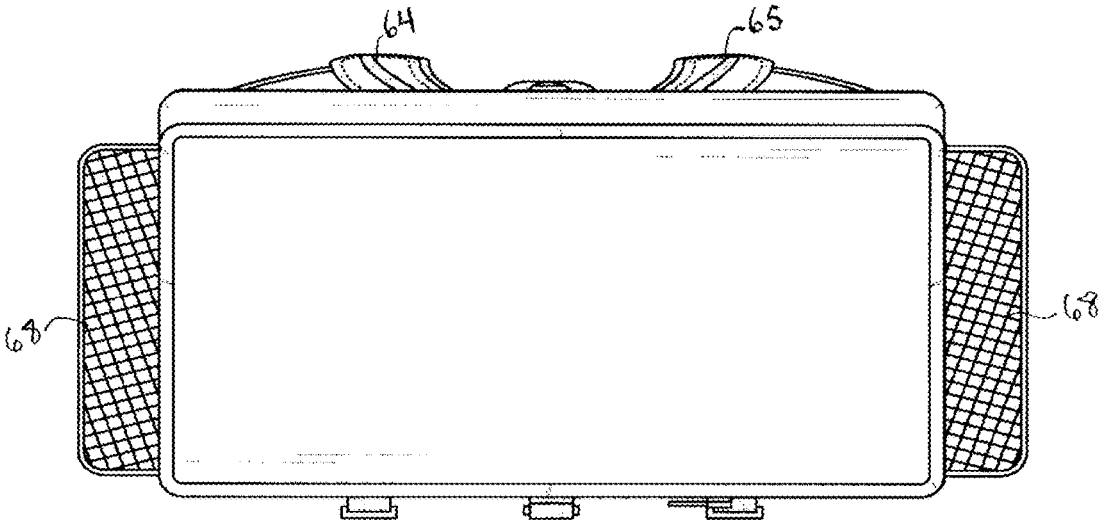
FIG. 11 illustrates an open interior view.

FIG. 11 generally depicts an open interior view of an embodiment with an open flap 10. The flap 10 is unbuckled and exposing the interior 54 of the embodiment. Also displayed, are the open side pockets 68.

Figure 12:
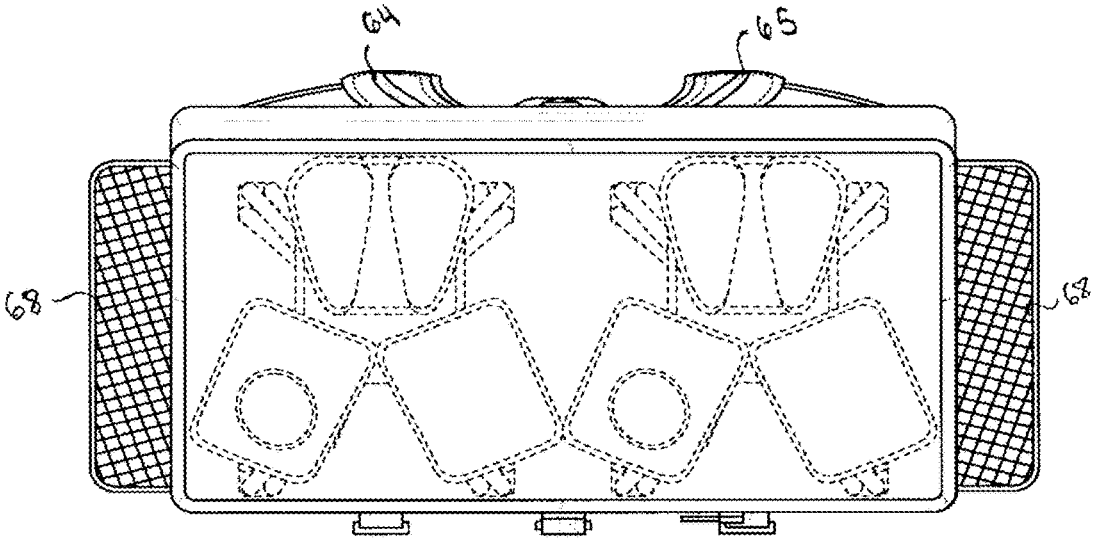
FIG. 12 illustrates an open interior view containing collapsible chairs.

FIG. 12 generally depicts an open interior view of an embodiment with an open flap 10 and containing quad chairs 90. The flap 10 is unbuckled and exposing the interior 54 of the embodiment. Also displayed, are the open side pockets 68. In one embodiment, a portable backpack allows for the storage and transport of a collapsible quad chair. The insertion or removal of the collapsible quad chair can occur when the portable backpack is standing or prone.

In one embodiment, the backpack may comprise a zippered pocket attached to the exterior surface of the flap. In one embodiment, the backpack may comprise an open side pocket attached to the first side panel. In one embodiment, the backpack may comprise an open side pocket attached to the second side panel. In one embodiment, the backpack may comprise at least one piece of cushion material forming a portion of an outer surface of the back panel. In one embodiment, the backpack may comprise at least one piece of cushion material forming a portion of an outer surface of the first strap. In one embodiment, the backpack may comprise at least one piece of cushion material forming a portion of an outer surface of the second strap. In one embodiment, the backpack may comprise at least one piece of cushion material forming a portion of an outer surface of the reinforced bottom. In one embodiment, the first strap may comprise a means for adjusting the length of the strap. In one embodiment, the second strap may comprise a means for adjusting the length of the strap. In one embodiment, the first upper buckle strap comprises a means for attaching to the first buckle. In one embodiment, the second upper buckle strap may comprise a means for attaching to the second buckle.

The present invention may be embodied in other forms without departing from the spirit and the essential attributes thereof, and, accordingly, reference should be made to the appended claims, rather than to the foregoing specification, as indicating the scope of the invention.

What is claimed is:

1. A portable backpack for the storage and transport of a collapsible quad chair, in which the insertion or removal of the collapsible quad chair can occur when the portable backpack is standing or prone, the portable backpack comprising:

a front panel having a front panel exterior surface, a front panel first side end, a front panel second side end, a front panel bottom end, and a front panel top end, wherein the front panel exterior surface comprises: a first lower buckle strap, a first buckle connected to the first lower buckle strap, a second lower buckle strap, a second buckle connected to the second lower buckle strap, a d-ring strap attached to the front panel exterior surface between the first lower buckle strap and the second lower buckle strap, wherein the d-ring strap has a looped end, a d-ring connected to the d-ring strap at the looped end, a upper molle strap attached to the front panel exterior surface, a lower molle strap attached to the front panel exterior surface;

a back panel having a back panel exterior surface, a back panel first side end, a back panel second side end, a back panel bottom end, and a back panel top end, wherein the back panel exterior surface comprises:

a loop having a first end and a second end, wherein the first end of the loop and the second end of the loop attach to the back panel exterior surface, a first strap comprising a first top end and a second bottom end, wherein the first top end and the second bottom end attach to the back panel exterior surface near the back panel top end and back panel bottom end, respectively, a second strap comprising a first top end and a second bottom end, where in the first top end and the second bottom end attach to the back panel exterior surface near the back panel top end and back panel bottom end, respectively, and a reinforcement strap connected to the back panel exterior surface, wherein the first end of the loop and the second end of the loop, the first top end of the first strap, and the first top end of the second strap, are positioned between the reinforcement strap and the back panel exterior surface, such that the reinforcement strap is configured to distribute a force placed on the first strap, second strap, and the loop;

a first side panel connected to the front panel first side end and the back panel first side end;

a second side panel connected to the front panel second side end and the back panel second side end;

a reinforced bottom connected to the front panel bottom end, the back panel bottom end, the first side panel, and the second side panel;

a flap having an exterior surface, a connection end, a buckle end, a first upper buckle strap, and a second upper buckle strap, wherein the back panel is flexible, wherein the connection end of the flap is attached to the back panel exterior surface at least 6 inches from the back panel top end, to prevent deformation of a rectangular opening created by the front panel top end, the back panel top end, a top end of the first side panel, and a top end of the second side panel, wherein the first upper buckle strap and the second upper buckle strap are attached to the buckle end of the flap, and wherein the flap can be moved between a closed position in which it closes the rectangular opening and an open position in which it leaves the rectangular opening open to expose an interior of the backpack.

2. The backpack of claim 1, further comprising a zippered pocket attached to the exterior surface of the flap.

3. The backpack of claim 1, further comprising an open side pocket attached to the first side panel.

4. The backpack of claim 1, further comprising an open side pocket attached to the second side panel.

5. The backpack of claim 1, further comprising at least one piece of cushion material forming a portion of an outer surface of the back panel.

6. The backpack of claim 1, further comprising at least one piece of cushion material forming a portion of an outer surface of the first strap.

7. The backpack of claim 1, further comprising at least one piece of cushion material forming a portion of an outer surface of the second strap.

8. The backpack of claim 1, further comprising at least one piece of cushion material forming a portion of an outer surface of the reinforced bottom.

9. The backpack of claim 1, wherein the first strap comprises a means for adjusting the length of the strap.

10. The backpack of claim 1, wherein the second strap comprises a means for adjusting the length of the strap.

11. The backpack of claim 1, wherein the first upper buckle strap comprises a means for attaching to the first buckle.

12. The backpack of claim 1, wherein the second upper buckle strap comprises a means for attaching to the second buckle.

13. The backpack of claim 1, wherein the attachment end of the flap is positioned between the reinforcement strap and the back panel exterior surface.

14. A portable backpack for the storage and transport of a collapsible quad chair, in which the insertion or removal of the collapsible quad chair can occur when the portable backpack is standing or prone, the portable backpack comprising:

a front panel having a front panel exterior surface, a front panel first side end, a front panel second side end, a front panel bottom end, and a front panel top end;

a back panel having a back panel exterior surface, a back panel first side end, a back panel second side end, a back panel bottom end, and a back panel top end, wherein the back panel exterior surface comprises: a first strap comprising a first top end and a second bottom end, where in the first top end and the second bottom end attach to the back panel exterior surface near the back panel top end and back panel bottom end, respectively, a second strap comprising a first top end and a second bottom end, where in the first top end and the second bottom end attach to the back panel exterior surface near the back panel top end and the back panel bottom end, respectively, a reinforcement strap connected to the back panel exterior surface, wherein the first top end of the first strap, and the first top end of the second strap are positioned between the reinforcement strap and the back panel exterior surface, wherein the reinforcement strap is configured to distribute a force placed on the first strap and the second strap;

a first side panel connected to the front panel first side end and the back panel first side end;

a second side panel connected to the front panel second side end and the back panel second side end;

a reinforced bottom connected to the front panel bottom end, the back panel bottom end, the first side panel, and the second side panel; and a flap having a flap exterior surface, a first flap end, and a flap connection end opposite the first flap end, wherein the first flap end is configured to detachably couple with the front panel exterior surface via an attachment component, wherein a rectangular opening is created by the front panel top end, the back panel top end, a top end of the first side panel, and a top end of the second side panel, wherein the back panel is flexible, wherein the flap can be moved between a closed position in which it closes the rectangular opening, and an open position in which it leaves the rectangular opening open to expose an interior of the backpack, wherein the flap connection end is attached to the back panel exterior surface at a distance below the back panel top end to provide a clearance between the back panel top end and the flap connection end, to prevent deformation of the rectangular opening when the flap is in the open position.

15. The backpack of claim 14, wherein the flap connection end is attached to the back panel exterior surface at least 6 inches below the back panel top end.

16. The backpack of claim 14, further comprising a loop having a first end and a second end, wherein the first end of the loop and the second end of the loop are positioned between the reinforcement strap and the back panel exterior surface.

17. The backpack of claim 14, wherein the attachment end of the flap is positioned between the reinforcement strap and the back panel exterior surface.

* * * * *